US011193329B1

(12) United States Patent
Crider et al.

(10) Patent No.: US 11,193,329 B1
(45) Date of Patent: Dec. 7, 2021

(54) QUICK RELEASE CURTAIN CLOSURE SYSTEM

(71) Applicant: HH Technologies, Inc., Bremen, AL (US)

(72) Inventors: Brett L. Crider, Bremen, AL (US); Daniel Ashby, Jasper, AL (US)

(73) Assignee: HH Technologies, Inc., Bremen, AL (US)

( * ) Notice: Subject to any disclaimer, the term of this patent is extended or adjusted under 35 U.S.C. 154(b) by 232 days.

(21) Appl. No.: 16/280,524

(22) Filed: Feb. 20, 2019

(51) Int. Cl.
*E06B 9/58* (2006.01)

(52) U.S. Cl.
CPC ..... *E06B 9/581* (2013.01); *E06B 2009/585* (2013.01)

(58) Field of Classification Search
CPC ..... E06B 9/581; E06B 9/58; E06B 2009/585; E06B 9/56; E06B 9/40; E06B 2009/587; E06B 2009/588
See application file for complete search history.

(56) References Cited

U.S. PATENT DOCUMENTS 4,282,919 A * 8/1981 Teno ..... E06B 9/17015 160/23.1
4,317,480 A * 3/1982 Phelps ..... E06B 9/40 160/23.1
4,433,712 A * 2/1984 Mellon ..... A47H 99/00 160/122
4,458,739 A * 7/1984 Murray ..... E06B 9/582 160/23.1
5,566,736 A 10/1996 Crider et al.
5,752,557 A 5/1998 Crider et al.
5,785,105 A 7/1998 Crider et al.
5,960,847 A 10/1999 Crider et al.
6,138,739 A 10/2000 Crider et al.
6,942,001 B1 9/2005 Crider et al.
7,128,125 B2 10/2006 Harbison
7,631,683 B2 12/2009 Crider
7,802,607 B2 9/2010 Crider
7,828,037 B2 11/2010 Crider
8,016,014 B2 9/2011 Crider et al.
8,439,099 B1 5/2013 Crider
8,919,415 B1 12/2014 Crider
(Continued)

*Primary Examiner* — Gregory J Strimbu
*Assistant Examiner* — Jeremy C Ramsey
(74) *Attorney, Agent, or Firm* — Bush Intellectual Property Law; Kenneth M. Bush

(57) ABSTRACT

A closure apparatus for covering a portal is disclosed herein. In various aspects, the closure apparatus includes a curtain assembly having one or more curtains and a spindle assembly mounted superjacent a portal on an exterior of the portal. The spindle assembly is operably engaged with the curtain assembly to extend the curtain assembly to cover the portal and retract the curtain assembly to uncover the portal. Channels disposed on lateral sides of the portal engage the curtain assembly when the curtain assembly is extended to cover the portal. Front channel members, which are pivotably connected to corresponding adjacent supports, pivot to release the curtain assembly from engagement with the channels upon application of sufficient force to the curtain assembly to allow egress or ingress through the portal when the closure apparatus is not operational, for example, during loss of power. Related methods of operation of the closure apparatus are also disclosed.

4 Claims, 6 Drawing Sheets

(56) References Cited

U.S. PATENT DOCUMENTS

| | | | | |
|---|---|---|---|---|
| 9,512,669 | B2 * | 12/2016 | Šentjurc | E06B 9/58 |
| 2009/0008039 | A1 * | 1/2009 | Lambridis | E06B 9/40<br>160/121.1 |
| 2014/0190097 | A1 * | 7/2014 | Drifka | E06B 9/11<br>52/204.1 |
| 2015/0041076 | A1 * | 2/2015 | Andre de la Porte | E06B 9/581<br>160/266 |
| 2019/0119980 | A1 | 4/2019 | Crider | |
| 2019/0336801 | A1 * | 11/2019 | Edwards | E06B 9/68 |

* cited by examiner

QUICK RELEASE CURTAIN CLOSURE SYSTEM

FIELD OF THE INVENTION

The present disclosure relates to portal closures, and, more particularly, to a closure apparatus that includes curtain(s) releasably secured about the portal to cover the portal.

BACKGROUND OF THE INVENTION

Various closure devices cover and uncover a portal using one or more curtains received by one or more spindles. The spindle(s) may be mounted superjacent the portal and the one or more curtains may be extended by being unwound from the spindle(s) in order to cover the portal and may be retracted by winding onto the spindle(s) in order to uncover the portal. The portal may be, for example, a door, entryway, window, or passageway and the portal may, for example, pass between an exterior and an interior configured as a freezer, cold room, storage room, warehouse, garage, or various other commercial or industrial space.

A user located within the interior with the one or more curtains covering the portal must retract the one or more curtains thereby uncovering the portal in order to egress through the portal. Unfortunately, the closure device may fail so that the one or more curtains cannot be retracted thereby trapping the user interior, which could be dangerous. Various emergencies such as fire, chemical release, explosions, steam release, or flooding may occur interior the portal and the time waiting for the one or more curtains to retract in order to egress through the portal may be deleterious. Also, malfunction such as electrical malfunction or mechanical malfunction may prevent retraction of the one or more curtains thereby preventing egress from the interior or ingress into the interior from the exterior.

Accordingly, there is a need for improved apparatus as well as related methods that cover and uncover a portal using one or more curtains received by one or more spindles while allowing egress through the portal when the portal is covered by the one or more curtains.

SUMMARY OF THE INVENTION

These and other needs and disadvantages may be overcome by the closure apparatus and related methods of operation of the closure apparatus disclosed herein. Additional improvements and advantages may be recognized by those of ordinary skill in the art upon study of the present disclosure.

In various aspects, the closure apparatus disclosed herein includes a curtain assembly having one or more curtains and a spindle assembly mounted superjacent a portal. The spindle assembly is operably engaged with the curtain assembly to extend the curtain assembly to cover said portal and retract the curtain assembly to uncover said portal, in various aspects. Front channel members define, in part, channels located on lateral sides of the portal in cooperation with the spindle assembly and the curtain assembly, and the channels engage the curtain assembly when the curtain assembly is extended to cover the portal, in various aspects. The front channel members, which are pivotably connected to corresponding adjacent supports, pivot to release the curtain assembly from engagement with the channels upon application of a force equal to or greater than a release force to the curtain assembly. Upon release of the curtain assembly from the channels, a user may push the curtain assembly aside in order to pass through the portal. Related methods of operation of the closure apparatus are disclosed herein.

This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

Figure 1:
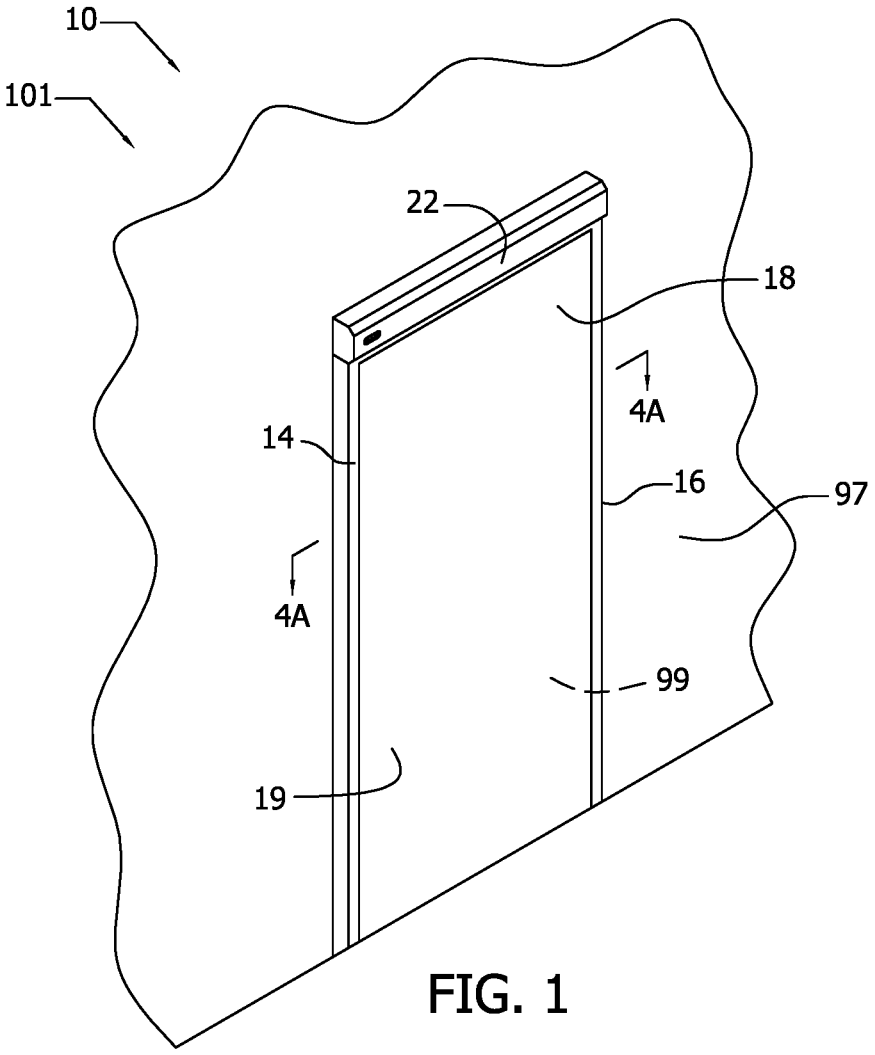
FIG. 1 illustrates by exterior perspective view an exemplary implementation of a closure apparatus in an engaged state.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "interior," "exterior," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances such as ±0.1%, ±1%, ±2.5%, ±5%, or other such tolerances, as would be recognized by those of ordinary skill in the art upon study of this disclosure.

DETAILED DESCRIPTION OF THE INVENTION

A closure apparatus is disclosed herein that may be released at least in part from engagement about the portal, for example, to allow escape through the portal during an emergency, or to allow access or escape through the portal in the event of malfunction of the closure apparatus. In various aspects, the closure apparatus includes a curtain assembly comprising one or more curtains and a spindle assembly mounted superjacent the portal. The spindle assembly is operably engaged with the curtain assembly to extend the curtain assembly to cover the portal and to retract the curtain assembly to uncover the portal. Channels located at lateral margins of the portal receive the curtain assembly when the curtain assembly is extended to cover the portal. The channels are formed, in part, by front channel members, and the front channel members pivot to release the curtain assembly from engagement with the channels upon application of a force F greater than or equal to a release force $F_R$ to the curtain assembly. When the curtain assembly is released from engagement with the channels by pivoting of the front channel members, a user may pass through the portal by pushing aside at least portions of the curtain assembly.

Accordingly, for example, the user may egress from the interior through the portal when the curtain assembly covers the portal by releasing the engagement of at least portions of the curtain assembly with the channels without retracting the curtain assembly from the portal. Thus, the user does not need to wait for retraction of the curtain assembly from the portal before egressing through the portal, which may be advantageous in an emergency situation or in the event of malfunction of the closure apparatus. In addition, the curtain assembly may be released from engagements with the channels to allow ingress through the portal from exterior to interior, for example, in the event of malfunction or emergency.

As illustrated in FIG. 1, closure apparatus 10 includes structures 14, 16 spaced apart at lateral margins exterior 97 of portal 99, spindle assembly 22 mounted superjacent portal 99 exterior 97 of portal 99, and curtain assembly 18 that cooperates with structures 14, 16 and spindle assembly 22. Curtain assembly 18 is extended from spindle assembly 22 and secured over portal 99 by attachment with structures 14, 16 to cover portal 99 on the exterior 97 when closure apparatus 10 is in engaged state 101, as illustrated in FIG. 1.

It should be recognized that the FIG. 1 implementation may be reversed in other implementations so that, for example, structures 14, 16 are spaced apart at lateral margins interior 93 of portal 99, spindle assembly 22 is mounted superjacent portal 99 on the interior 93, and curtain assembly 18 is positioned interior 93 of portal 99 in cooperation with structures 14, 16 and spindle assembly 22.

Curtain assembly 18 may include dual curtains 17, 19 windingly received on spindles (not shown) rotatably mounted within spindle assembly 22. Rotation of the spindles allows curtain assembly 18 to be extended from curtain assembly 18 to cover portal 99 or retracted into curtain assembly 18 to uncover portal 99. A user may, for example, extend or retract curtain assembly 18 to cover or uncover portal 99 as the user desires using control 13 (see FIG. 2) located interior 93 of portal 99, in this implementation. Spindle(s) of spindle assembly 22 are rotated by reversible drive electric motor(s) (not shown), and control 13 is in operative communication with the electric motor(s) to control the extension or retraction of curtain assembly 18, in this implementation. Control 13 may be located exterior 97 of portal 99, or multiple controls, such as control 13, may be located interior 93 and exterior 97 of portal 99, in various other implementations. Spindle assembly 22 may include various other mechanisms that allow the curtain assembly 18 to be extended to cover portal 99 or retracted to uncover portal 99, including spindle(s) rotated solely by mechanical user actuated mechanisms, in other implementations, as would be readily recognized by those of ordinary skill in the art upon study of this disclosure.

Structures 14, 16 and spindle assembly 22 may be formed of steel, aluminum, fiberglass, various plastics, and combinations thereof, as would be readily recognized by those of ordinary skill in the art upon study of this disclosure. Curtains 17, 19 of curtain assembly 18 may be formed, for example, of various fabrics or textiles such as canvas, burlap or woven polymers, flexible metal mesh, flexible sheets of plastic such as polyester or polyethylene, or combinations thereof, in various implementations.

Figure 4A:
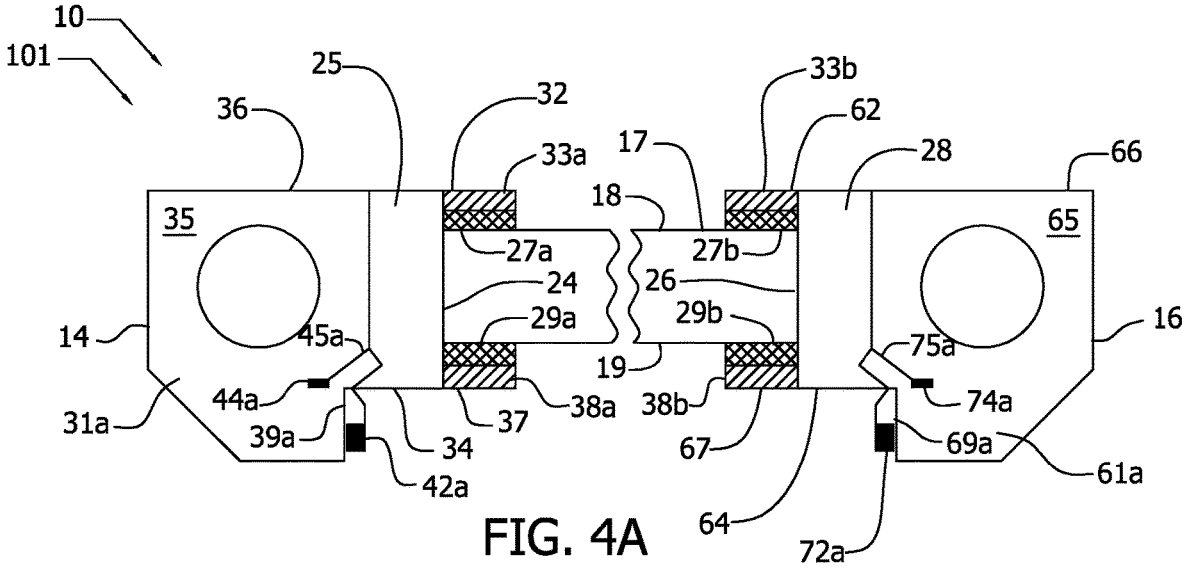
FIG. 4A illustrates by top cut-away view portions of the exemplary implementation of the closure apparatus of FIG. 1 in the engaged state.

FIGS. 1, 4A illustrates portions of closure apparatus 10 including structures 14, 16 and curtain assembly 18 with closure apparatus 10 in engaged state 101. As illustrated, curtain assembly 18 is extended to cover portal 99, and curtain assembly 18 is attached to structures 14, 16 in engaged state 101. Structure 14, as illustrated in FIG. 4A, includes support 36, rear channel member 32, and front channel member 34. Support 36 may be formed as a unitary structure with braces, such as braces 31*a*, 31*b* illustrated in FIG. 5A, insertably received within cavity 35 defined within support 36, or support 36 may be formed of multiple panels secured surroundingly to braces, such as braces 31*a*, 31*b*. Thus, braces, such as braces 31*a*, 31*b*, are disposed within cavity 35 defined within support 36. Braces, such as braces 31*a*, 31*b*, may allow for fabrication of support 36 from the multiple panels either as a pre-assembled unit or assembly in-situ, in various implementations, and the braces may add structural strength to support 36. As illustrated in FIG. 4A, structure 16, which is the mirror image of structure 14, includes support 66, rear channel member 62, and front channel member 64. Braces, such as braces 61*a*, 61*b* illustrated in FIG. 5B, are received within cavity 65 defined within support 66.

As illustrated in FIG. 4A, rear channel members 32, 62 are secured fixedly to support 36, 66, respectively, for example, by being formed as a unitary structure with at least portions of support 36, 66, by fastener, by adhesive, or by weld. Rear channel members 32, 62 in combination with supports 36, 66 are secured against lateral margins of portal 99, as illustrated.

Figure 5A:
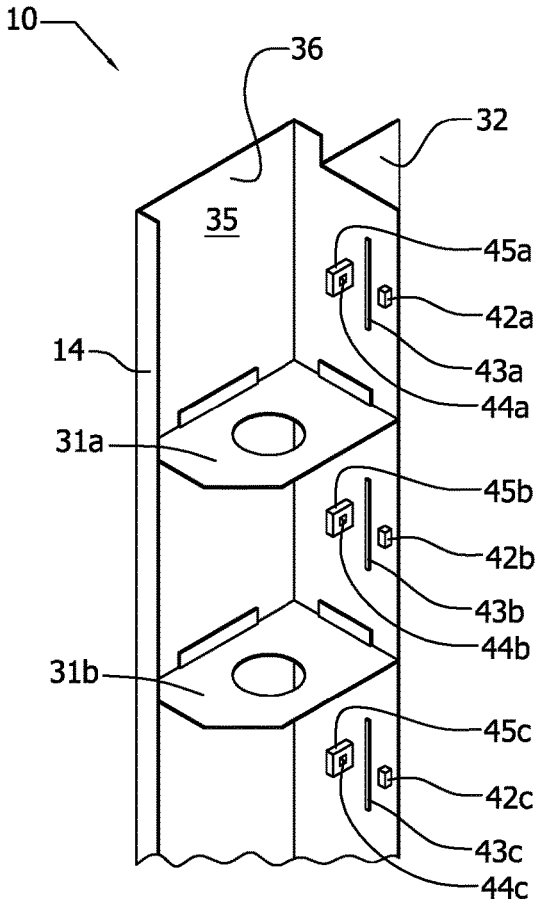
FIG. 5A illustrates by side cut-away perspective view portions of the exemplary implementation of the closure apparatus of FIG. 1.
Figure 6A:
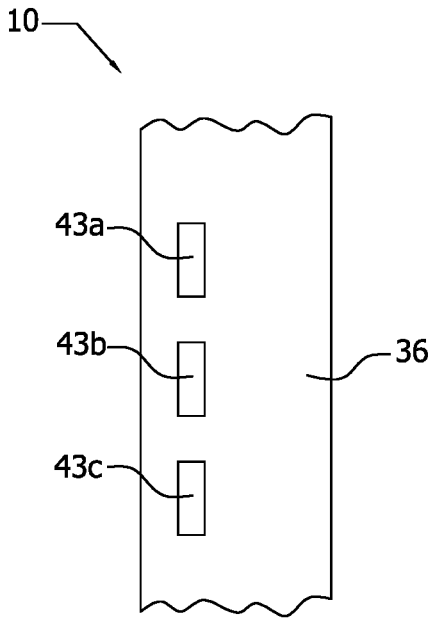
FIG. 6A illustrates by side view portions of the exemplary implementation of the closure apparatus of FIG. 1.
Figure 6B:
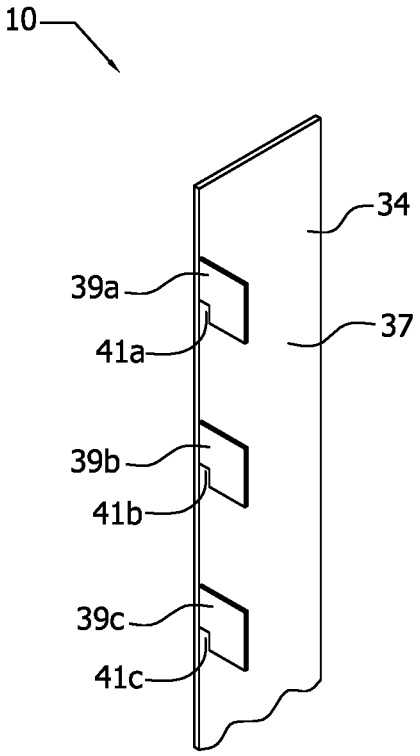
FIG. 6B illustrates by side perspective view portions of the exemplary implementation of the closure apparatus of FIG. 1.

As illustrated in FIG. 4A, front channel member 34 includes channel member portion 37 and flanges, such as flanges 39*a*, 39*b*, 39*c* illustrated in FIG. 6B, set generally at right angles with channel member portion 37 in an L-shaped configuration, and flanges, such as flanges 39*a*, 39*b*, 39*c*, are disposed lengthwise along channel member portion 37. Flanges, such as flanges 39*a*, 39*b*, 39*c*, illustrated in FIG. 6B, are insertably received within cavity 35 through corresponding slots, such as slots 43*a*, 43*b*, 43*c* illustrated in FIGS. 5A, 6A, in support 36 to hingedly secure front channel member 34 with support 36. Notches in the flanges, such as notches 41*a*, 41*b*, 41*c* in flanges 39*a*, 39*b*, 39*c*, respectively, engage the flanges with portions of support 36 proximate the slots, such as slots 43*a*, 43*b*, 43*c*, to retain the flanges in the slots, in this implementation.

Figure 5B:
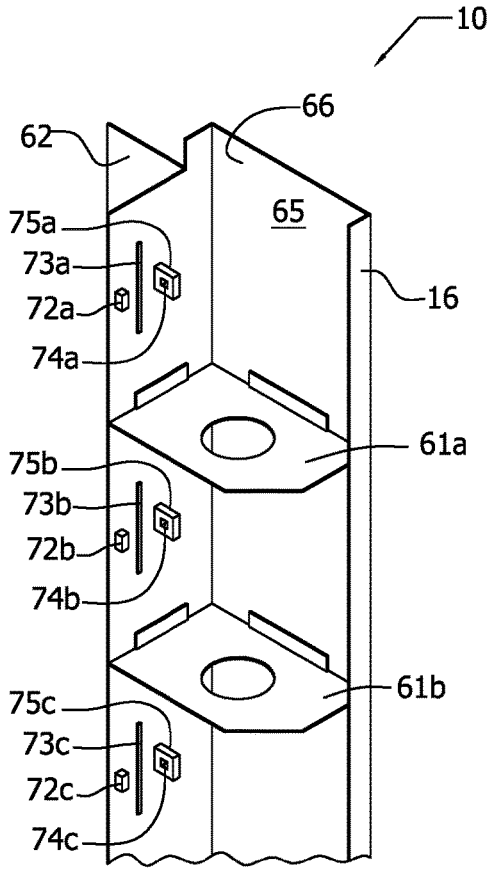
FIG. 5B illustrates by side cut-away perspective view portions of the exemplary implementation of the closure apparatus of FIG. 1.
Figure 6C:
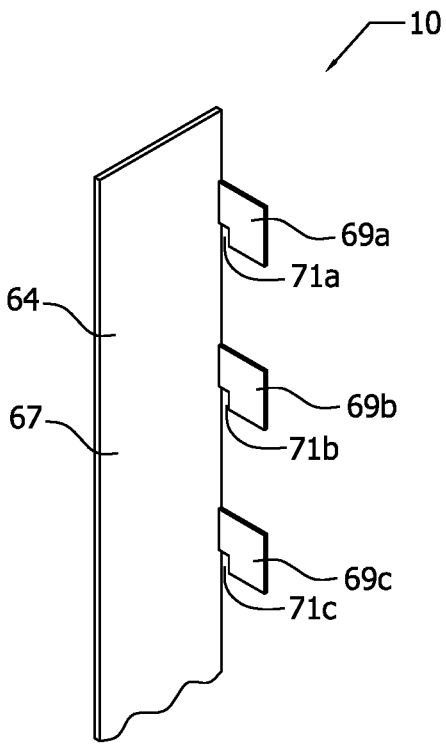
FIG. 6C illustrates by side perspective view portions of the exemplary implementation of the closure apparatus of FIG. 1; and, FIG. 7 illustrates by process flow chart an exemplary method of operation of the closure apparatus of FIG. 1.

Similarly, as illustrated in FIG. 4A, front channel member 64 includes channel member portion 67 and flanges, such as flanges 69*a*, 69*b*, 69*c* illustrated in FIG. 6C, set generally at right angles with channel member portion 67 and disposed lengthwise along channel member portion 67. Flanges, such as flanges 69*a*, 69*b*, 69*c*, are insertably received within cavity 65 through corresponding slots, such as slots 73*a*, 73*b*, 73*c* illustrated in FIG. 5B, in support 66 to hingedly secure front channel member 64 with support 66. Notches in the flanges, such as notches 71*a*, 71*b*, 71*c* in flanges 69*a*, 69*b*, 69*c*, respectively, engage the flanges with portions of support 66 proximate the slots, such as slots 73*a*, 73*b*, 73*c*, to retain the flanges in the slots.

When closure apparatus 10 is in engaged state 101, as illustrated in FIG. 4A, flanges, such as flanges 39*a*, 39*b*, 39*c*, are magnetically engaged with magnets located on support 36, such as magnets 42*a*, 42*b*, 42*c* illustrated in FIG. 5A, to hold channel member portion 37 of front channel member 34 generally parallel with rear channel member 32 thereby defining channel 25. Similarly, flanges, such as flanges 69*a*, 69*b*, 69*c*, are magnetically engaged with magnets located on support 66, such as magnets 72*a*, 72*b*, 72*c* illustrated in FIG. 5B, to hold channel member portion 67 of front channel member 64 generally parallel with rear channel member 62 thereby defining channel 28 when closure apparatus 10 is in engaged state 101.

In engaged state 101, curtain assembly 18 is received securably releasably in channels 25, 28 with curtain 17 of curtain assembly 18 attached to rear channel members 32, 62 by engagement of rear curtain fasteners 27*a*, 27*b* with rear channel member fasteners 33*a*, 33*b* located on rear channel members 32, 62 and with curtain 19 of curtain assembly 18 attached to front channel members 34, 64 by engagement of front curtain fasteners 29*a*, 29*b* with front channel member fasteners 38*a*, 38*b* located on front channel members 34, 64, respectively. Rear curtain fasteners 27*a*, 27*b* and front curtain fasteners 29*a*, 29*b*, may be located proximate sides 24, 26 of curtain assembly 18 to engage with rear channel member fasteners 33*a*, 33*b* and front channel member fasteners 38*a*, 38*b* located generally within channels 25, 28. Rear curtain fasteners 27*a*, 27*b*, rear channel member fasteners 33*a*, 33*b*, front curtain fasteners 29*a*, 29*b*, and front channel member fasteners 38*a*, 38*b* may be various corresponding fasteners such as hook and loop fasteners, magnetic fasteners such as magnetic strips, or combinations thereof.

Curtain assembly 18 cooperates with spindle assembly 22 to engage or disengage curtain rear curtain fasteners 27*a*, 27*b* with rear channel member fasteners 33*a*, 33*b* and front curtain fasteners 29*a*, 29*b* with front channel member fasteners 38*a*, 38*b*, respectively, as curtain assembly 18 is respectively extended or retracted, in various implementations. Exemplary implementations of curtain assembly 18 and exemplary implementations of spindle assembly 22 are disclosed, for example, in U.S. Pat. Nos. 6,138,739, 7,828,037, 8,439,099, and International Patent Application No. PCT/US2017/022471, all of which are hereby incorporated by reference in their entireties herein.

Figure 2:
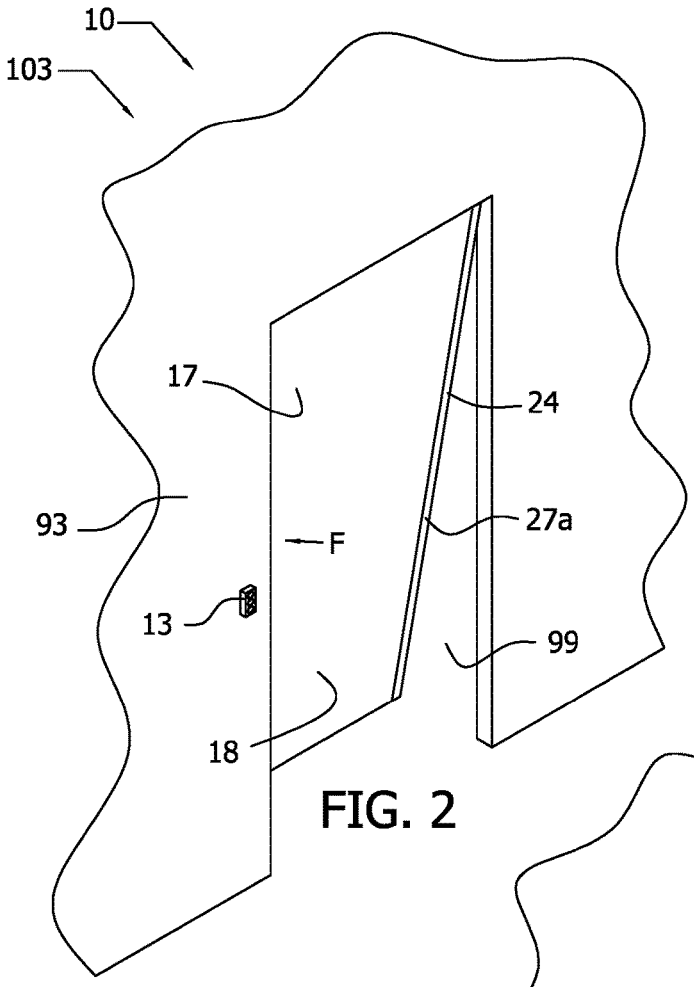
FIG. 2 illustrates by interior perspective view the exemplary implementation of the closure apparatus of FIG. 1 in a released state.
Figure 3:
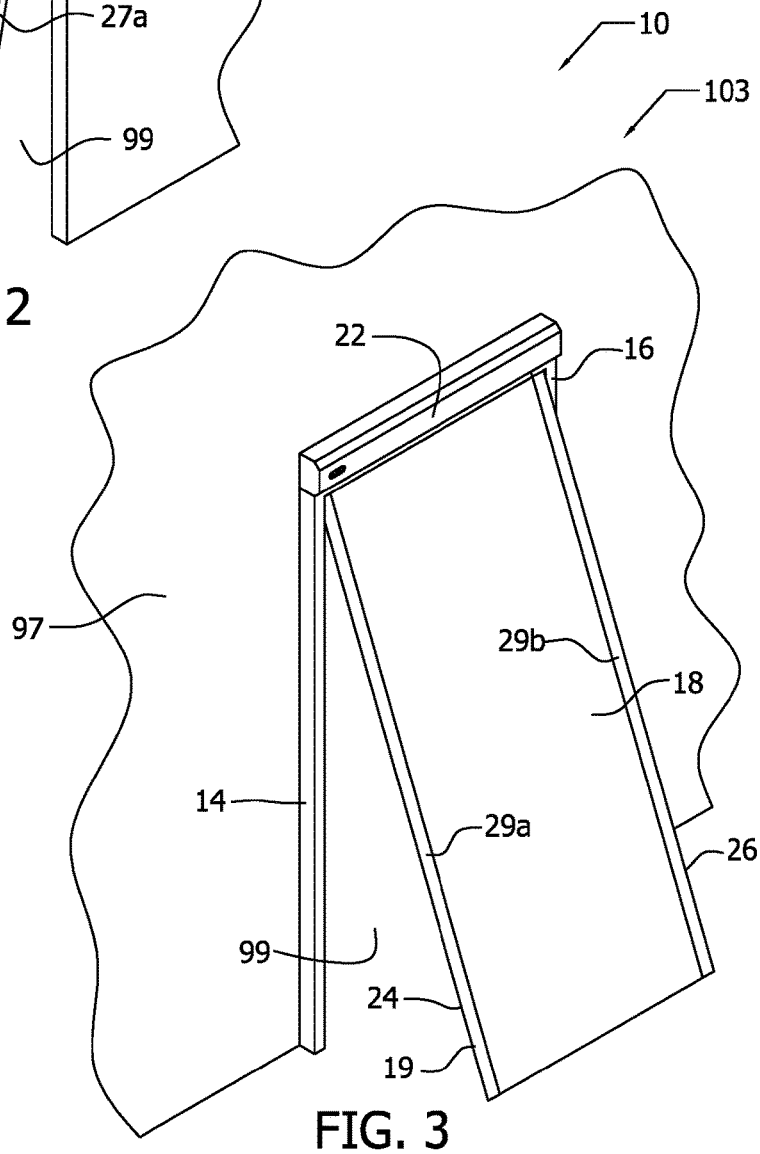
FIG. 3 illustrates by exterior perspective view the exemplary implementation of the closure apparatus of FIG. 1 in a released state.
Figure 4B:
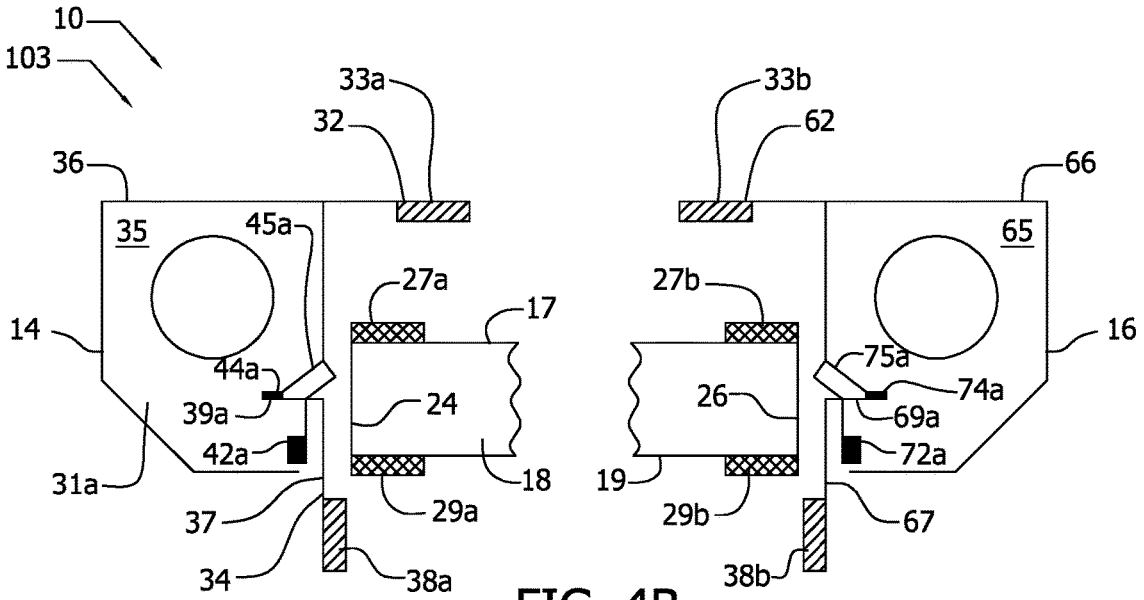
FIG. 4B illustrates by top cut-away view portions of the exemplary implementation of the closure apparatus of FIG. 1 in the released state.

FIGS. 2, 3, 4B illustrate closure apparatus 10 in released state 103. In released state 103, curtain assembly 18 is extended and sides 24, 26 of curtain assembly 18 are detached from structures 14, 16, respectively, so that curtain assembly 18 swings freely from spindle assembly 22 thereby allowing egress through portal 99 from interior 93, illustrated in FIG. 2, to exterior 97, illustrated in FIG. 3. Released state 103 of closure apparatus 10 allows egress through portal 99 from interior 93 to exterior 97 or ingress through portal 99 from exterior 97 to interior 93 without the necessity of uncovering portal 99 by raising curtain assembly 18 using spindle assembly 22.

As illustrated in FIG. 4B, flanges, such as flanges 39*a*, 39*b*, 39*c*, are magnetically engaged with magnets, such as magnets 44*a*, 44*b*, 44*c*, to hold channel member portion 37 generally perpendicular with respect to rear channel member 32 thereby opening channel 25 when closure apparatus 10 is in released state 103. For example, channel 25 alters from a U-shaped configuration in engaged state 101 illustrated in FIG. 4A to an L-shaped configuration in released state 103 illustrated in FIG. 4B.

Similarly, when closure apparatus 10 is in released state 103, flanges, such as flanges 69*a*, 69*b*, 69*c*, are magnetically engaged with magnets, such as magnets 74*a*, 74*b*, 74*c*, to hold channel member portion 67 generally perpendicular with respect to rear channel member 62 thereby opening channel 28, as illustrated in FIG. 4B. Channel 28 is thus altered from a U-shaped configuration in engaged state 101 illustrated in FIG. 4A to an opened L-shaped configuration in released state 103 illustrated in FIG. 4B. With channels 25, 28 opened as illustrated in FIG. 4B, curtain assembly 18 is operable to disengage from rear channel members 32, 62 and from front channel members 34, 64 allowing curtain assembly 18 to swing freely from spindle assembly 22 as illustrated in FIGS. 2, 3 when closure apparatus 10 is in released state 103. With closure apparatus 10 in released state 103, a user may push the curtain assembly aside in order to egress or ingress through portal 99.

Magnets, such as magnets 44*a*, 44*b*, 44*c*, 74*a*, 74*b*, 74*c*, are mounted on stops, such as stops 45*a*, 45*b*, 45*c*, 75*a*, 75*b*, 75*c*, respectively, that limit the pivot of front channel members 34, 64, for example, to approximately 90°. In other implementations, front channel members 34, 36 may pivot to angles other than approximately 90°. Stops, such as stops 45*a*, 45*b*, 45*c*, 75*a*, 75*b*, 75*c*, may be welded or fastened to supports 36, 66, or may be formed by bending portions of supports 36, 66, in various implementations. In some implementations, front channel members 34, 64 may be formed of steel or similar ferrous material to be magnetically attachable with magnets, such as magnets 42*a*, 42*b*, 42*c*, 44*a*, 44*b*, 44*c*, 72*a*, 72*b*, 72*c*, 74*a*, 74*b*, 74*c*. In other implementations, magnets or magnetic material may be disposed about the flanges, such as flanges 39*a*, 39*b*, 39*c* and about flanges 69*a*, 69*b*, 69*c* to engage with magnets 42*a*, 42*b*, 42*c*, 44*a*, 44*b*, 44*c*, and magnets 72*a*, 72*b*, 72*c*, 74*a*, 74*b*, 74*c*, respectively. Hook and loop fasteners or other releasable fasteners and combinations of releasable fasteners may be substituted for magnets 42*a*, 42*b*, 42*c*, 44*a*, 44*b*, 44*c*, 72*a*, 72*b*, 72*c*, 74*a*, 74*b*, 74*c*, in other implementations.

In operation, curtain assembly 18 may be extended forth from spindle assembly 22 and secured over portal 99 by attachment with structures 14, 16 to cover portal 99, and curtain assembly 18 may be retracted generally intro spindle assembly 22 to uncover portal 99 as directed by the user, for example, using control 13 in operable communication with one or more spindles within spindle assembly 22.

Closure apparatus 10 is in exemplary engaged state 101 when curtain assembly 18 extends forth to cover portal 99 and curtain assembly 18 is received in channels 25, 28 of structures 14, 16, respectively. When closure apparatus 10 is in engaged state 101, the user located, for example, interior 93 of portal 99 may apply a force F (see FIG. 2) against curtain assembly 18 generally normal to curtain assembly 18 in order to alter closure apparatus from engaged state 101 to exemplary released state 103. Force F is then distributed from curtain assembly 18 to front channel members 34, 64 causing front channel members 34, 64 to pivot hingedly approximately 90° thereby altering channel member portions 37, 67 from a parallel alignment with rear channel members 32, 62 to a perpendicular alignment with rear channel members 32, 62, respectively. Flanges, such as flanges 39*a*, 39*b*, 39*c*, 69*a*, 69*b*, 69*c*, are released from magnetically engagement with magnets, such as magnets 42*a*, 42*b*, 42*c*, 72*a*, 72*b*, 72*c*, into engagement with magnets, such as magnets 44*a*, 44*b*, 44*c*, 74*a*, 74*b*, 74*c*, as channel member portions 37, 67 are altered by application of force F from being in parallel alignment with rear channel members 32, 62 in engaged state 101 to being in perpendicular alignment with rear channel members 32, 62 in released state 103, respectively. Magnets, such as magnets 44*a*, 44*b*, 44*c*, 74*a*, 74*b*, 74*c*, may exert greater magnetic force on front channel members 34, 36 than magnets, such as magnets 42*a*, 42*b*, 42*c*, 72*a*, 72*b*, 72*c*, to assist in pivoting of front channel members 34, 36 as closure apparatus 10 is altered from engaged state 101 to disengaged state 103 by application of force F.

Force F is equal to or greater in magnitude than the release force $F_R$ that is required to release flanges, such as flanges 39*a*, 39*b*, 39*c*, 69*a*, 69*b*, 69*c*, from magnetic engagement with magnets, such as magnets 42*a*, 42*b*, 42*c*, 72*a*, 72*b*, 72*c*, in various implementations. Accordingly, magnets, such as magnets 42*a*, 42*b*, 42*c*, 72*a*, 72*b*, 72*c*, as well as the number and size of flanges, such as flanges 39*a*, 39*b*, 39*c*, 69*a*, 69*b*, 69*c*, may be selected to size release force $F_R$. For example, release force $F_R$ may be sized to be greater than other anticipated ambient forces on curtain assembly 18 such as air current forces or minor impacts in order to prevent ambient forces from inadvertently altering closure apparatus 10 from engaged state 101 into released state 103.

As force F is applied against curtain assembly 18, rear curtain fasteners 27*a*, 27*b* disengage from rear channel member fasteners 33*a*, 33*b* thereby disengaging curtain assembly 18 from rear channel members 32, 62. Front curtain fasteners 29*a*, 29*b* disengage from front channel member fasteners 38*a*, 38*b* thereby disengaging curtain assembly 18 from front channel members 34, 64 as front channel members 34, 64 pivot to align channel member portions 37, 67 perpendicularly to rear channel members 32, 62, respectively. With channel member portions 37, 67 perpendicular to rear channel members 32, 62, respectively, curtain assembly 18 thus hangs freely from spindle assembly 22 disengaged from rear channel members 32, 62 and disengaged from front channel members 34, 64, in released state 103 allowing the user to egress from interior 93 to exterior 97 through portal 99 by pushing aside curtain assembly 18, which is now detached from portal 99.

The user may alter closure apparatus from engaged state 101 to released state 103 in order to ingress from exterior 97 to interior 93 through portal 99, and the user may push aside curtain assembly 18, which is detached from portal 99, as the user ingresses from exterior 97 to interior 93 through portal 99. For example, the user may pull on front channel members 34, 64 and curtain assembly 18 by hand in order to alter closure apparatus from engaged state 101 to released state 103 while the user is positioned exteriorly. One or more straps or other such grippable element(s) may be disposed about curtain assembly 18 exteriorly that facilitate alteration of the closure apparatus from engaged state 101 to released state 103 by the user located on the exterior 97, in various implementations. The front channel members 34, 64 may be formed with grippable features that facilitate hand rotation of front channel members 34, 64 from exterior 97, in various implementations.

The user may alter closure apparatus 10 from released state 103 to engaged state 101 by retracting curtain assembly 18 generally into spindle assembly 22 and then manually pivoting front channel members 34, 64 from perpendicular alignment of channel member portions 37, 67 with rear channel members 32, 62 to parallel alignment of channel member portions 37, 67 with rear channel members 32, 62 thereby re-forming U-shaped channels 25, 28, respectively. Curtain assembly 18 may then be extended from spindle assembly 22 into channels 25, 28 to cover portal 99.

Figure 7:
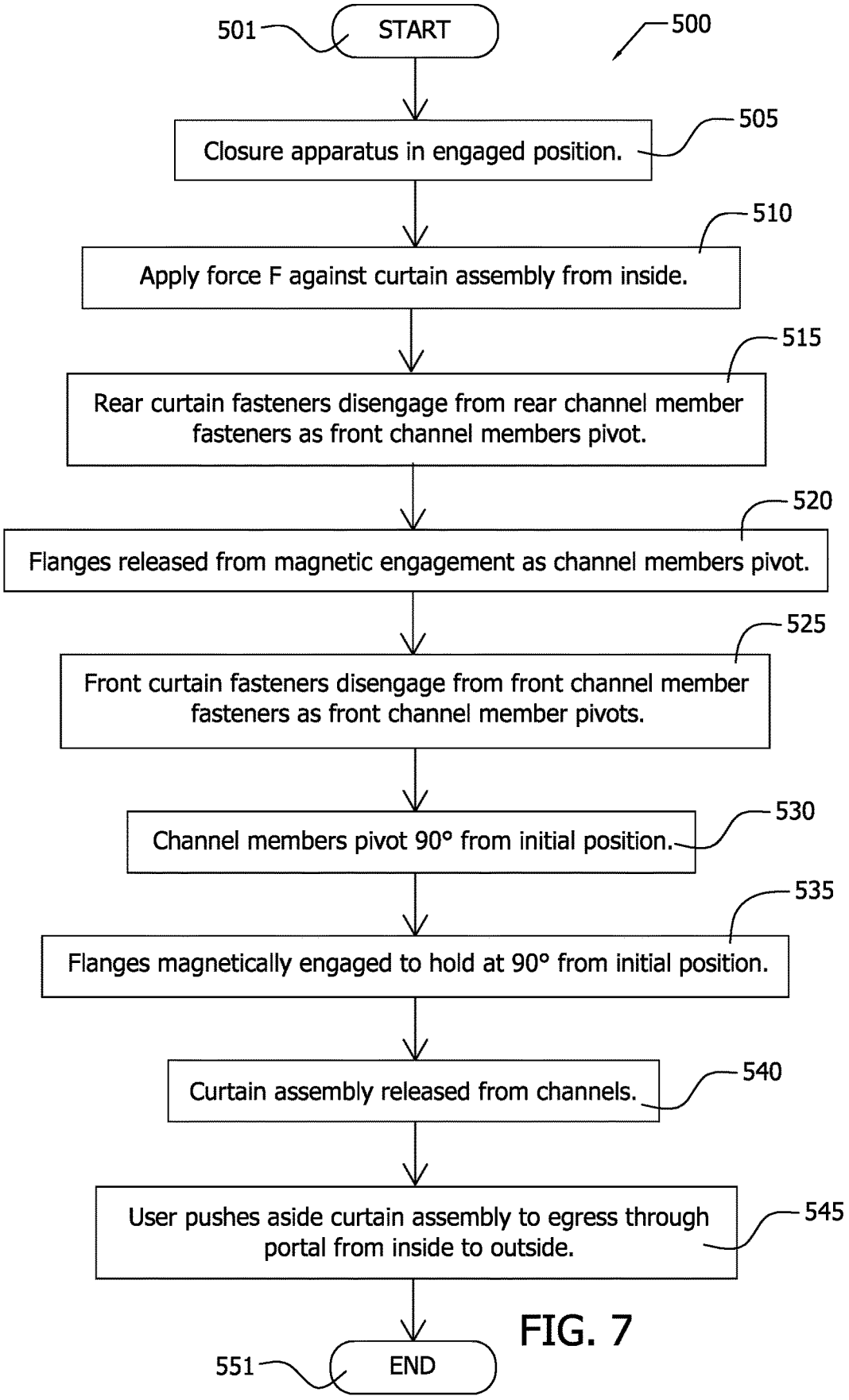

An exemplary method of operation 500 of closure apparatus 10 is illustrated in FIG. 7. Method of operation 500 is entered at step 501 with closure apparatus 10 in engaged state 101, per step 505.

At step 510, the user, who is located on the interior 93 of portal 99 applies force F, which is equal to or greater than release force $F_R$, against curtain assembly 18 generally normal to curtain assembly 18 in order to alter closure apparatus from engaged state 101 into released state 103.

At step 515, rear curtain fasteners 27*a*, 27*b* are disengaged from rear channel member fasteners 33*a*, 33*b* thereby disengaging curtain assembly 18 from rear channel members 32, 62 variously under the impetus of force F.

At step 520, flanges, such as flanges 39*a*, 39*b*, 39*c*, 69*a*, 69*b*, 69*c*, are released from magnetic engagement with magnets, such as magnets 42*a*, 42*b*, 42*c*, 72*a*, 72*b*, 72*c*, as channel members 34, 64 pivot under force F.

At step 525, front curtain fasteners 29*a*, 29*b* disengage from front channel member fasteners 38*a*, 38*b* thereby disengaging curtain assembly 18 from front channel members 34, 64 as front channel members 34, 64 are pivoted.

At step 530, front channel members 34, 64 pivot 90° thereby altering channel member portions 37, 67 from being in parallel alignment with rear channel members 32, 62 to being in perpendicular alignment with rear channel members 32, 62, respectively, under the impetus of force F.

At step 535, flanges, such as flanges 39*a*, 39*b*, 39*c*, 69*a*, 69*b*, 69*c*, magnetically engage magnets, such as magnets 44*a*, 44*b*, 44*c*, 74*a*, 74*b*, 74*c*, to hold channel member portions 37, 67 in perpendicular alignment with rear channel members 32, 62.

At step 540 the curtain assembly 18 is released from engagement with channels 25, 28. Curtain assembly 18 hangs freely from spindle assembly 22 disengaged from rear channel members 32, 62 and disengaged from front channel members 34, 64, in released state 103.

At step 545, the user egresses through portal 99 from interior 93 to exterior 97 by pushing aside curtain assembly 18. Thus, the user may escape from interior 93 through portal 99 without retracting curtain assembly 18. Exemplary method 500 terminates at step 551.

The foregoing discussion along with the Figures discloses and describes various exemplary implementations. These implementations are not meant to limit the scope of coverage, but, instead, to assist in understanding the context of the language used in this specification and in the claims. The Abstract is included to meet requirements of 37 C.F.R. § 1.72(b) only. This Abstract is not intended to identify key elements of the apparatus and methods disclosed herein or to delineate the scope thereof. Upon study of this disclosure and the exemplary implementations herein, one of ordinary skill in the art may readily recognize that various changes, modifications and variations can be made thereto without departing from the spirit and scope of the inventions as described herein and as defined by the following claims.

The invention claimed is:

1. A closure apparatus for covering a portal, comprising:

a) a curtain assembly comprising at least one curtain;

b) a spindle assembly mounted superjacent the portal, the spindle assembly operably engaged with the curtain assembly to extend the curtain assembly to cover the portal and retract the curtain assembly to uncover the portal;

c) channel members that define channels disposed on lateral sides of the portal, wherein the channels engage the curtain assembly when the curtain assembly is extended to cover the portal, wherein each of the channel members comprises a support structure, at least one first magnet, at least one second magnet, a rear channel member, and a front channel member, wherein each front channel member has a first end for engaging the curtain assembly and a second end for engaging a respective one of the support structures;

d) wherein each front channel member is pivotably connected to the respective one of the support structures, wherein each front channel member is operable to pivot 90 degrees between an engaged position and a released position;

e) wherein each front channel member is parallel to a respective one of the rear channel members when each front channel member is in the engaged position, wherein the curtain assembly is secured between each rear channel member and each front channel member when the curtain assembly is extended to cover the portal and each front channel member is in the engaged position;

f) wherein each front channel member is perpendicular to the respective one of the rear channel members when each front channel member is in the released position, wherein the curtain assembly is released from engagement with the channels to allow egress through the portal when the curtain assembly is extended to cover the portal and each front channel member is in the released position; and g) wherein each front channel member is releasably maintained in the engaged position through magnetic interaction between each front channel member and a respective one of the at least one first magnets, wherein each front channel member is releasably maintained in the released position through magnetic interaction between each front channel member and a respective one of the at least one second magnets, wherein each front channel member is operable to pivot from the engaged position to the released position to release the curtain assembly from engagement with the channels upon application of sufficient force from the curtain assembly against each front channel member.

2. A closure apparatus for covering a portal, comprising:

a) a curtain assembly comprising at least one curtain;

b) a spindle assembly mounted superjacent the portal, the spindle assembly operably engaged with the curtain assembly to extend the curtain assembly to cover the portal and retract the curtain assembly to uncover the portal;

c) channel members that define channels disposed on lateral sides of the portal, wherein the channels engage the curtain assembly when the curtain assembly is extended to cover the portal, wherein each of the channel members comprises a support structure, at least one first fastener, at least one second fastener, a rear channel member, and a front channel member, wherein each front channel member has a first end for engaging the curtain assembly and a second end for engaging a respective one of the support structures;

d) wherein each front channel member is pivotably connected to the respective one of the support structures, wherein each front channel member is operable to pivot 90 degrees between an engaged position and a released position;

e) wherein each front channel member is parallel to a respective one of the rear channel members when each front channel member is in the engaged position, wherein the curtain assembly is secured between each rear channel member and each front channel member when the curtain assembly is extended to cover the portal and each front channel member is in the engaged position;

f) wherein each front channel member is perpendicular to the respective one of the rear channel members when each front channel member is in the released position, wherein the curtain assembly is released from engagement with the channels to allow egress through the portal when the curtain assembly is extended to cover the portal and each front channel member is in the released position; and g) wherein each front channel member is releasably maintained in the engaged position through interaction between each front channel member and a respective one of the at least one first fasteners, wherein each front channel member is releasably maintained in the released position through interaction between each front channel member and a respective one of the at least one second fasteners, wherein each front channel member is operable to pivot from the engaged position to the released position to release the curtain assembly from engagement with the channels upon application of sufficient force from the curtain assembly against each front channel member.

3. A closure apparatus according to claim 2, wherein each at least one first fastener is a magnet.

4. A closure apparatus according to claim 2, wherein each at least one second fastener is a magnet.

* * * * *